US006098240A

United States Patent [19]

Taylor

[11] Patent Number: 6,098,240

[45] Date of Patent: Aug. 8, 2000

[54] AXIALLY SECURABLE ROLLER PAINT APPLICATOR

[76] Inventor: Andrew M. Taylor, P.O. Box 700287, San Antonio, Tex. 78270

[21] Appl. No.: 09/144,754

[22] Filed: Sep. 1, 1998

[51] Int. Cl.[7] ..... B05C 17/02

[52] U.S. Cl. ..... 15/230.11; 15/230; 492/13; 492/19; 492/48

[58] Field of Search ..... 15/230, 230.11; 492/13, 14, 16, 17, 18, 19, 48

[56] References Cited

U.S. PATENT DOCUMENTS

| | | |
|---|---|---|
| 2,766,473 | 10/1956 | Thackara . |
| 2,891,301 | 6/1959 | Conklin . |
| 3,346,904 | 10/1967 | Armstrong . |
| 3,522,681 | 8/1970 | Lampert . |
| 3,877,123 | 4/1975 | Pharris . |
| 3,886,621 | 6/1975 | Welsh . |
| 4,257,140 | 3/1981 | Downing . |
| 4,316,301 | 2/1982 | Smith et al. . |
| 4,402,102 | 9/1983 | Al-samman . |
| 4,467,509 | 8/1984 | Dezen . |
| 4,557,011 | 12/1985 | Sartori . |
| 4,758,290 | 7/1988 | McMakin . |
| 4,897,893 | 2/1990 | Barker . |
| 4,907,313 | 3/1990 | Roeker et al. . |
| 5,167,055 | 12/1992 | Stoddart et al. . |
| 5,339,484 | 8/1994 | Polzin et al. . |
| 5,584,092 | 12/1996 | Polzin et al. . |
| 5,594,971 | 1/1997 | Nelson . |
| 5,613,264 | 3/1997 | Knowles . |
| 5,613,265 | 3/1997 | Gemmell . |
| 5,755,004 | 5/1998 | Miller . |

*Primary Examiner*—Terrence R. Till
*Assistant Examiner*—Jennifer McNeil
*Attorney, Agent, or Firm*—Royston, Rayzor, Vickery, Novak & Druce, L.L.P.

[57] ABSTRACT

An axially securable roller paint applicator that includes a substantially cylindrical body having an inner core constructed from form retaining material and an outer paint absorbent covering substantially surrounding the inner core. The body has a first end for location proximate to a handle assembly of a rotary roller paint applicator holder when the body is slidingly engaged upon such a rotary roller paint applicator holder. A second end of the body is located distally away from the handle assembly of the rotary roller paint applicator holder when the body is engaged upon the holder. An end cap is configured for engagement with the second end of the body for preventing axial movement of the body on the rotary roller paint applicator holder when the body is installed for use. The end cap has an interior surface configured for face-to-face releasable interlocking engagement with an exterior end surface of the rotary roller paint applicator holder. In one embodiment, the interior surface of the end cap is at least partially covered in a hooked-surface component of a hook-and-loop fastener combination. The hooked-surface component is exteriorly exposed for facilitating the face-to-face releasable interlocking engagement with the exterior end surface of the holder which is adapted with a looped-surface component of a hook-and-loop fastener combination.

13 Claims, 2 Drawing Sheets

AXIALLY SECURABLE ROLLER PAINT APPLICATOR

TECHNICAL FIELD

The present inventions relates generally to paint applicators; and more specifically, the invention relates to roller-type paint applicators commonly used in the painting of building interiors and exteriors.

BACKGROUND ART

Roller-type paint applicators are well known in the art. A deficiency in present designs, however, has been recognized by personnel who regularly use the applicators. Over extended periods of use, current tubular paint applicators tend to work off of their carrying rotary spindles. In typical configurations, the roller paint applicator is retained upon a rotary spindle exclusively by the frictional fit therebetween. As a result of varying forces experienced in the painting process, it is common for the cylindrical roller paint applicator to begin to slowly migrate away from the handled end of the rotary applicator holder. This is an undesirable characteristic and one which must be periodically remedied by the user pushing the roller back onto the spindle. In almost all cases, all possible points of contact are covered with paint and there is no suitable engagement area for the user to apply a re-positioning force to such a dislocated roller applicator.

This characteristic of conventionally designed roll paint applicators has been recognized in U.S. Pat. No. 2,766,473 to Thackara for a Rotary Paint Applicator. In the '473 patent, this gradual disengagement is prevented through the use of a securing end cap that engages a distal end of the rotary axle of the carrying spindle utilizing a U-shaped spring clip that is adapted to have one leg engage within a recess slot upon the axil. This solution to the problem, however, requires multiple components and relatively complicated interactions within the securing mechanism. Still further, the easy engagement of face-to-face surfaces is not utilized as in the present invention.

In view of the above described deficiencies associated with the use of known roller paint applicators, the present invention has been developed to alleviate these drawbacks and provide further benefits to the user. These enhancements and benefits are described in greater detail herein below with respect to several alternative embodiments of the present invention.

DISCLOSURE OF THE INVENTION

The present invention in its several disclosed embodiments alleviates the drawbacks described above with respect to conventionally designed roller paint applicators and incorporates several additionally beneficial features.

Common commercial designs for the rotary roller paint applicator holders terminate at a distal end from the handle in a flat face or in a surface that can easily be adapted to present a flat distal face directed away from the handle assembly of the applicator holder. The present invention utilizes a conventionally designed roller applicator, but with the incorporation of a securing end cap that matingly engages the flat face of the holder with a releasable fixative between the abutting surfaces. By including fixing components interstitially between the end cap and the end surface of the holder, that end cap can be utilized to secure the roller body upon the rotary spindle of the holder and resist their relative displacement.

It has been found to be advantageous to provide for the easy installation and disengagement of a roller head upon a spindle holder. During use and while the roller applicator is engaged upon the spindle, it is highly desirable to have its position fixed relative thereto so that the gradual disengagement discussed above is prevented.

One particularly suitable configuration for accomplishing this securement is to form an end cap either by securement or as an integral component together with the roller body of the paint applicator. In this configuration, an interior surface of the end cap can be adapted to have an adhesive exposed toward the holder or one of the mating components of a hook-and-loop securing combination. To affect securement between the paint roller and the holder, a mating component for the adhesive or hook-and-loop member on the end cap is provided on the flat end area of the receiving spindle of the holder. Through such a configuration, it is possible for the roller paint applicator to be manually engaged upon the receiving spindle and pressed sufficiently tightly thereupon to cause mating engagement between the securing components which come into face-to-face engagement at an interface of the roller and the holder. Either using attractive adhesives, the hook-and-loop combination or their equivalents, disengagement of the paint roller applicator from the holder is resisted until intentional separated through the application of a sufficient pulling force by the user. In this manner the gradual and unintended "creep" of the roller applicator off of the holder is avoided.

In at least one embodiment, the present invention is an axially securable roller paint applicator. The applicator includes a substantially cylindrical body that has an inner core constructed from form retaining material and an outer paint absorbent covering substantially surrounding the inner core. The body has a first end for location proximate to a handle assembly of a rotary roller paint applicator holder when the body is slidingly engaged upon such a rotary roller paint applicator holder. A second end of the body is located distally away from the handle assembly of the rotary roller paint applicator holder when the body is engaged upon the holder. An end cap is configured for engagement with the second end of the body for preventing axial movement of the body on the rotary roller paint applicator holder when the body is installed for use. The end cap has an interior surface configured for face-to-face releasable interlocking engagement with an exterior end surface of the rotary roller paint applicator holder.

In the illustrated embodiment, the interior surface of the end cap is at least partially covered in a hooked-surface component of a hook-and-loop fastener combination. The hooked-surface component is exteriorly exposed for facilitating the face-to-face releasable interlocking engagement with the exterior end surface of the holder which is adapted with a looped-surface component of a hook-and-loop fastener combination.

The beneficial effects described above apply generally to each of the exemplary devices and mechanisms disclosed herein regarding the maintenance of proper positioning of a paint roller head upon a rotary holder. The specific structures through which these benefits may be delivered will be described in detail herein below.

BRIEF DESCRIPTION OF THE DRAWINGS

The invention will now be described in greater detail in the following way of example only and with reference to the attached drawings, in which.

MODE(S) FOR CARRYING OUT THE INVENTION

Figure 1:
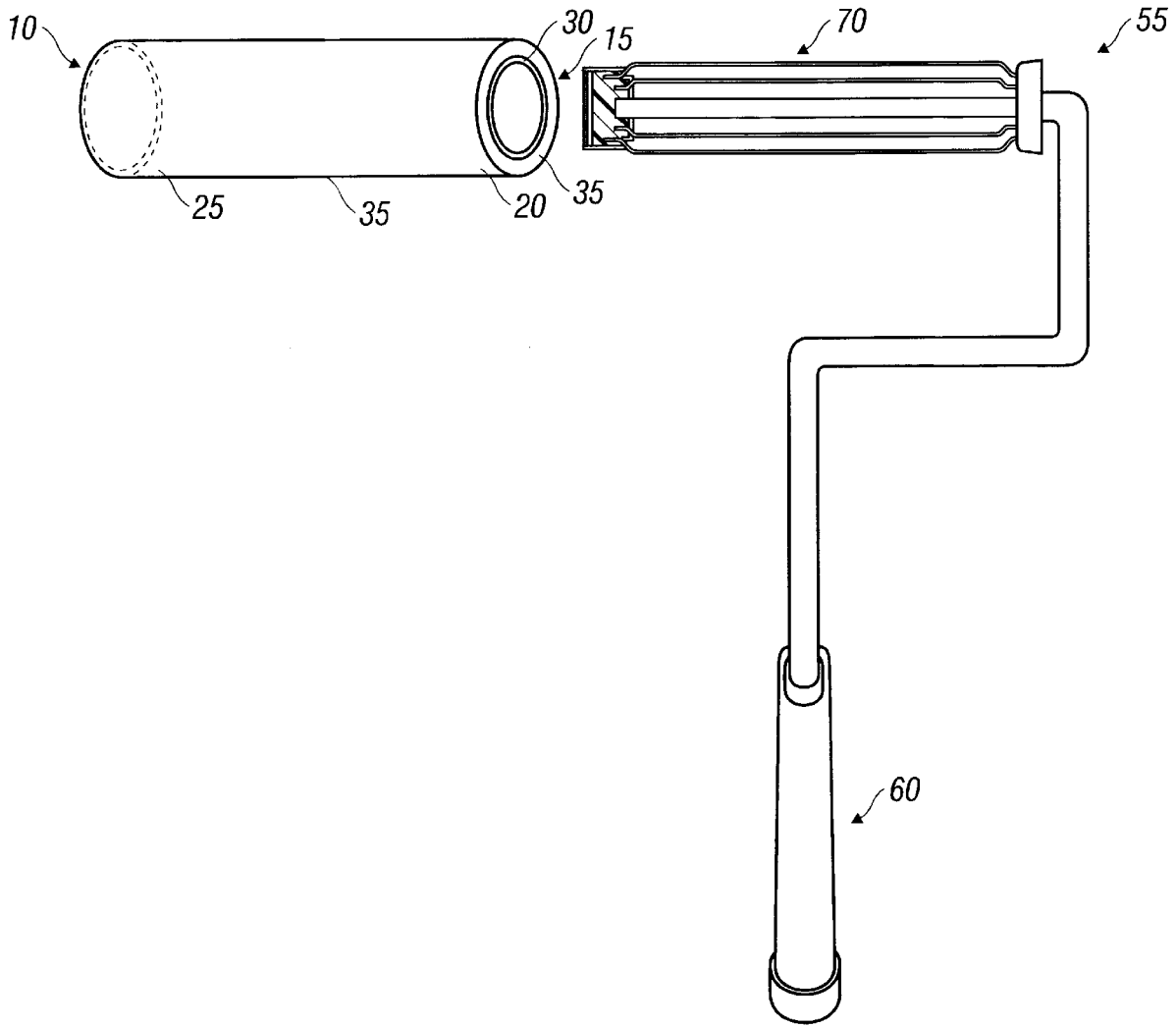
FIG. 1 is an exploded perspective view of a axially securable roller paint applicator positioned for secured engagement upon a conventionally designed rotary roller paint applicator holder.
Figure 2:
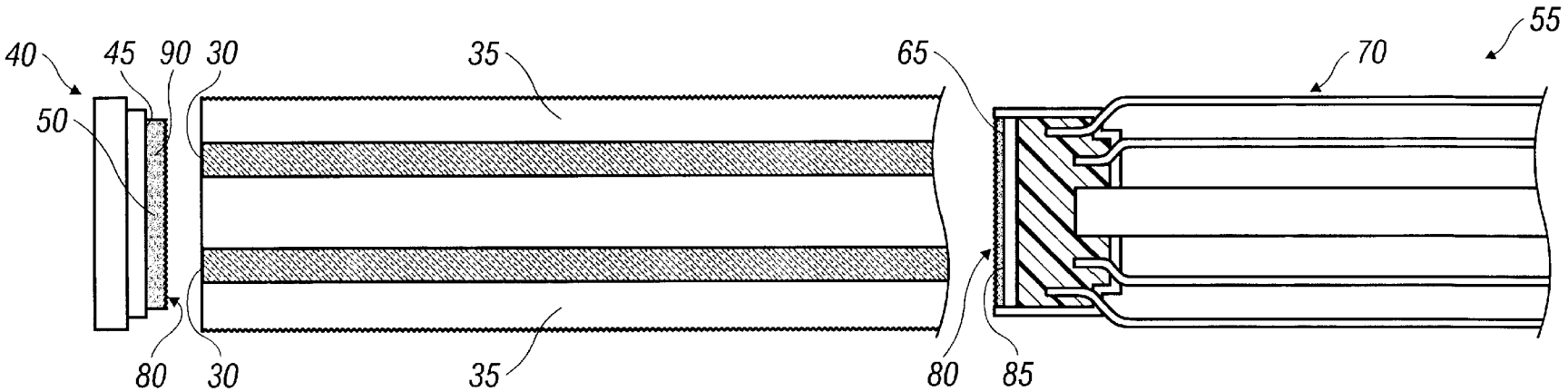
FIG. 2 is an elevational cross-sectional view showing the cooperation between the securable roller paint applicator and an appropriately configured rotary holder.

As required, detailed embodiments of the present invention are disclosed herein; however, it is to be understood that the disclosed embodiments are merely exemplary of the invention that may be embodied in various and alternative forms. The figures are not necessarily to scale, some features may be exaggerated or minimized to show details of particular components. Therefore, specific structural and functional details disclosed herein are not to be interpreted as limiting, but merely as a basis for the claims and as a representative basis for teaching one skilled in the art to variously employ the present invention.

Referring to the drawings, an axially securable roller paint applicator 10 properly configured for retained positioning upon a rotary roller paint applicator holder 55 is shown. The roller paint applicator 10 includes a substantially cylindrical body 15 having a first end 20 and a second end 25. The body 15 has as a constituent member an inner core 30 constructed from a material that retains its shape under normal use conditions. An outer paint absorbent covering 35 is secured about the inner core 30 and is used for applying paint directly to a structural surface such as wall or ceiling. During use, the roller paint applicator 10 is slidingly engaged upon a receiving rotary spindle 70 of the holder 55. At a first end of the spindle 70 is a handle assembly 60. At an opposite and distal end of the spindle 70 is an exterior end surface 65. It is not uncommon for such exterior end surface 65 to be on a hub component of the spindle 70. When the roller applicator 10 is properly installed upon the holder 55, the first and second ends 20,25 of the cylindrical body 15 of the applicator 10 generally positioned adjacent to corresponding first and second ends of the spindle 70.

An end cap 40 is provided either as a separate component or integrally constructed with the cylindrical body 15 of the applicator 10 at the second end 25 thereof. The end cap 40 has an interior surface 45 which in a preferred embodiment is substantially disc shaped and presents a flat surface having an engaging portion 50 configured for face-to-face engagement with the corresponding exterior end surface 65 of the holder 55.

In use, the cylindrical body 15 is pressingly engaged upon the receiving rotary spindle 70 of the holder 55. In this manner, the interior surface 45 of the end cap 40 and the exterior end surface 65 of the rotary spindle 70 are brought into contacting and engagement.

As described herein above, the invention resists or prevents unintentional disengagement of the paint roller 10 from the holder 55. To accomplish the desired releasable securement, the end cap 40 and exterior end surface 65 are adapted with connectable components that can be releasably engaged for service. One exemplary fixative is a hook-and-loop fastener combination 80 wherein the hooked-surface component 85 and the looped-surface component 90 are oppositely positioned on the abutting components; namely, the interior surface 45 of the end cap 40 and the exterior end surface 65 of the rotary spindle 70. Alternatively, an appropriate adhesive might be utilized for the same purpose as may a snap or other suitable adaptation.

An axially securable roller paint applicator 10 and its constituent components have been described herein. These and other variations, which will be appreciated by those skilled in the art are within the intended scope of this invention as claimed below. As previously stated, detailed embodiments of the present invention are disclosed herein; however, it is to be understood that the disclosed embodiments are merely exemplary of the invention that may be embodied in various forms.

INDUSTRIAL APPLICABILITY

The present invention finds applicability in the residential and commercial painting industries, and particularly those industries in which roller paint applicators are used.

What is claimed and desired to be secured by Letters Patent is as follows:

1. An axially securable roller paint applicator adapted to be positioned upon a rotary roller paint applicator holder, said applicator comprising:

a substantially cylindrical body having an inner core constructed from form retaining material and an outer paint absorbent covering substantially surrounding said inner core, said body having a first end for location proximate to a handle assembly of a rotary roller paint applicator holder when said body is slidingly engaged upon such a rotary roller paint applicator holder and a second end for location distally away from a handle assembly of a rotary roller paint applicator holder when said body is slidingly engaged upon such a rotary roller paint applicator holder;

an end cap configured for engagement with said second end of said body for preventing axial movement of said body on a rotary roller paint applicator holder when said body is slidingly engaged upon such a rotary roller paint applicator holder, said end cap having an interior surface configured for face-to-face releasable interlocking engagement with an exterior end surface of a rotary roller paint applicator holder when said body is slidingly engaged upon such a rotary roller paint applicator holder; and said interior surface of said end cap is at least partially covered in a tacky material exteriorly exposed for facilitating said face-to-face releasable interlocking engagement with an exterior end surface of a rotary roller paint applicator holder when said body is slidingly engaged upon such a rotary roller paint applicator holder.

2. The axially securable roller paint applicator as recited in claim 1; wherein said end cap is configured so that said face-to-face releasable interlocking engagement occurs over a majority of said interior surface of said end cap for preventing unintentional disengagement of said body from a rotary roller paint applicator holder.

3. The axially securable roller paint applicator as recited in claim 1; wherein said end cap is permanently secured to said body.

4. The axially securable roller paint applicator as recited in claim 1; wherein said end cap is integrally constructed with said body.

5. The axially securable roller paint applicator as recited in claim 1; wherein said interior surface of said end cap is substantially flat across an engaging portion of said interior surface.

6. An axially securable roller paint applicator adapted to be positioned upon a rotary roller paint applicator holder, said applicator comprising:

a substantially cylindrical body having an inner core constructed from form retaining material and an outer paint absorbent covering substantially surrounding said inner core, said body having a first end for location proximate to a handle assembly of a rotary roller paint applicator holder when said body is slidingly engaged upon such a rotary roller paint applicator holder and a second end for location distally away from a handle assembly of a rotary roller paint applicator holder when said body is slidingly engaged upon such a rotary roller paint applicator holder;

an end cap configured for engagement with said second end of said body for preventing axial movement of said body on a rotary roller paint applicator holder when said body is slidingly engaged upon such a rotary roller paint applicator holder, said end cap having an interior surface configured for face-to-face releasable interlocking engagement with an exterior end surface of a rotary roller paint applicator holder when said body is slidingly engaged upon such a rotary roller paint applicator holder; and said interior surface of said end cap is at least partially covered in a hooked-surface component of a hook-and-loop fastener combination, said hooked-surface component being exteriorly exposed for facilitating said face-to-face releasable interlocking engagement with an exterior end surface of a rotary roller paint applicator holder adapted with a looped-surface component of a hook-and-loop fastener combination when said body is slidingly engaged upon such a rotary roller paint applicator holder.

7. The axially securable roller paint applicator as recited in claim 6; wherein said end cap is configured so that said face-to-face releasable interlocking engagement occurs over a majority of said interior surface of said end cap for preventing unintentional disengagement of said body from a rotary roller paint applicator holder.

8. The axially securable roller paint applicator as recited in claim 6; wherein said end cap is configured so that said face-to-face releasable interlocking engagement occurs over a substantial entirety of said interior surface of said end cap for preventing unintentional disengagement of said body from a rotary roller paint applicator holder.

9. An axially securable roller paint applicator adapted to be positioned upon a rotary roller paint applicator holder, said applicator comprising:

a substantially cylindrical body having an inner core constructed from form retaining material and an outer paint absorbent covering substantially surrounding said inner core, said body having a first end for location proximate to a handle assembly of a rotary roller paint applicator holder when said body is slidingly engaged upon such a rotary roller paint applicator holder and a second end for location distally away from a handle assembly of a rotary roller paint applicator holder when said body is slidingly engaged upon such a rotary roller paint applicator holder;

an end cap configured for engagement with said second end of said body for preventing axial movement of said body on a rotary roller paint applicator holder when said body is slidingly engaged upon such a rotary roller paint applicator holder, said end cap having an interior surface configured for face-to-face releasable interlocking engagement with an exterior end surface of a rotary roller paint applicator holder when said body is slidingly engaged upon such a rotary roller paint applicator holder; and said interior surface of said end cap is at least partially covered in a looped-surface component of a hook-and-loop fastener combination, said looped-surface component being exteriorly exposed for facilitating said face-to-face releasable interlocking engagement with an exterior end surface of a rotary roller paint applicator holder adapted with a hooked-surface component of a hook-and-loop fastener combination when said body is slidingly engaged upon such a rotary roller paint applicator holder.

10. The axially securable roller paint applicator as recited in claim 9; wherein said end cap is configured so that said face-to-face releasable interlocking engagement occurs over a substantial entirety of said interior surface of said end cap for preventing unintentional disengagement of said body from a rotary roller paint applicator holder.

11. An axially securable roller paint applicator adapted to be positioned upon a rotary roller paint applicator holder, said applicator comprising:

a substantially cylindrical body having an inner core constructed from form retaining material and an outer paint absorbent covering substantially surrounding said inner core, said body having a first end for location proximate to a handle assembly of a rotary roller paint applicator holder when said body is slidingly engaged upon such a rotary roller paint applicator holder and a second end for location distally away from a handle assembly of a rotary roller paint applicator holder when said body is slidingly engaged upon such a rotary roller paint applicator holder;

an end cap configured for engagement with said second end of said body for preventing axial movement of said body on a rotary roller paint applicator holder when said body is slidingly engaged upon such a rotary roller paint applicator holder, said end cap having an interior surface configured for face-to-face releasable interlocking engagement with an exterior end surface of a rotary roller paint applicator holder when said body is slidingly engaged upon such a rotary roller paint applicator holder; and said end cap is configured so that said face-to-face releasable interlocking engagement occurs over a majority of said interior surface of said end cap for preventing unintentional disengagement of said body from a rotary roller paint applicator holder.

12. An axially securable roller paint applicator adapted to be positioned upon a rotary roller paint applicator holder, said applicator comprising:

a substantially cylindrical body having a core constructed from form retaining material and a paint absorbent covering at least partially surrounding said core, said body having a first end for location proximate to a handle assembly of a rotary roller paint applicator holder when said body is slidingly engaged upon such a rotary roller paint applicator holder and a second end for location distally away from a handle assembly of a rotary roller paint applicator holder when said body is slidingly engaged upon such a rotary roller paint applicator holder;

an end cap adapted for engagement with said second end of said body for preventing axial movement of said body on a rotary roller paint applicator holder when said body is slidingly engaged upon such a rotary roller paint applicator holder; and an interior surface of said end cap is at least partially covered in a tacky material for facilitating interlocking engagement with an exterior end surface of a rotary roller paint applicator holder when said body is slidingly engaged upon such a rotary roller paint applicator holder.

13. An axially securable roller paint applicator adapted to be positioned upon a rotary roller paint applicator holder, said applicator comprising:

a substantially cylindrical body having a core constructed from form retaining material and a paint absorbent covering at least partially surrounding said core, said body having a first end for location proximate to a handle assembly of a rotary roller paint applicator holder when said body is slidingly engaged upon such a rotary roller paint applicator holder and a second end for location distally away from a handle assembly of a rotary roller paint applicator holder when said body is slidingly engaged upon such a rotary roller paint applicator holder;

an end cap adapted for engagement with said second end of said body for preventing axial movement of said body on a rotary roller paint applicator holder when said body is slidingly engaged upon such a rotary roller paint applicator holder; and an interior surface of said end cap is at least partially covered in a hook-or-loop material for facilitating interlocking engagement with an exterior end surface of a rotary roller paint applicator holder having complimentary hook-or-loop material located thereon when said body is positioned upon such a rotary roller paint applicator holder.

* * * * *